US012588741B2

(12) United States Patent
Moskowitz

(10) Patent No.: US 12,588,741 B2
(45) Date of Patent: Mar. 31, 2026

(54) TRANSPORTER AND STAIRS CLIMBER FOR HEAVY LOADS

(71) Applicant: Max Moskowitz, Flushing, NY (US)

(72) Inventor: Max Moskowitz, Flushing, NY (US)

( * ) Notice: Subject to any disclaimer, the term of this patent is extended or adjusted under 35 U.S.C. 154(b) by 244 days.

(21) Appl. No.: 17/804,473

(22) Filed: May 27, 2022

(65) Prior Publication Data

US 2022/0378160 A1 Dec. 1, 2022

Related U.S. Application Data

(60) Provisional application No. 63/202,203, filed on Jun. 1, 2021.

(51) Int. Cl.

| | |
|---|---|
| ***A45C 5/14*** | (2006.01) |
| ***A45C 13/26*** | (2006.01) |
| ***A45C 13/30*** | (2006.01) |

(52) U.S. Cl.

CPC ..... *A45C 5/146* (2013.01); *A45C 13/262* (2013.01); *A45C 13/30* (2013.01)

(58) Field of Classification Search

CPC ..... A45C 5/146; A45C 13/262; A45C 13/30
USPC ..... 190/18 A
See application file for complete search history.

(56) References Cited

U.S. PATENT DOCUMENTS 6,446,987 B2 * 9/2002 Abraham ..... A45C 5/14 280/38
6,971,654 B2 * 12/2005 Amsili ..... B62B 1/125 280/47.27
8,033,369 B2 * 10/2011 Sherrell ..... A45C 13/00 280/DIG. 6
9,095,193 B1 * 8/2015 Al-Hashemi ..... A45C 5/146
10,463,123 B2 11/2019 Moskowitz et al.
2008/0001421 A1 * 1/2008 Matunaga ..... A61G 1/017 5/625
2009/0160147 A1 * 6/2009 Arthur ..... B62B 1/22 280/37
2010/0078279 A1 * 4/2010 Bowers ..... A45C 5/14 190/18 A
2010/0236886 A1 * 9/2010 Herold ..... A45C 7/0045 190/18 A
2017/0172266 A1 * 6/2017 Moskowitz ..... A45C 13/30

FOREIGN PATENT DOCUMENTS

CN 219906781 U * 10/2023

* cited by examiner

*Primary Examiner* — Nathan J Jenness
*Assistant Examiner* — Jessica Kavini Tamil
(74) *Attorney, Agent, or Firm* — OSTROLENK FABER LLP

(57) ABSTRACT

A wheeling apparatus for a suitcase has a wheeling frame defining a frame plane. A wheeling leg assembly pivotably is attached to the wheeling frame at a pivoting axis and is pivotably moveable between a first position adjacent and parallel to the wheeling frame plane and a second position extending at an adjustable angle to the wheeling frame plane. Leaning wheels are secured to the wheeling leg assembly. Straps enable the apparatus to be removably secured to the suitcase. A flexible wire having a first end attached to the wheeling leg assembly and a second end attachable to a holding device that is configured to firmly hold the second end at an adjustable location thereon and which is so configured as to allow a user to selectively adjust an inclination angle at which the wheeling leg assembly extends relative to the frame plane during use of the apparatus.

17 Claims, 13 Drawing Sheets

TRANSPORTER AND STAIRS CLIMBER FOR HEAVY LOADS

CROSS-REFERENCE TO RELATED APPLICATION

The present non-provisional patent application claims the benefit of and priority to U.S. Provisional Patent Application No. 63/202,203, filed Jun. 1, 2021 by Max Moskowitz, and entitled "TRANSPORTER AND STAIRS CLIMBER FOR HEAVY LOADS," the entire contents of which are incorporated herein by reference.

BACKGROUND OF THE INVENTION

The present invention is generally directed to luggage carts and carriers and more particularly to luggage and heavy load carts with stairs climbing capabilities.

The present invention builds upon and provides improvements to the carts described in the present inventor's disclosure in U.S. Pat. No. 10,463,123 ("the '123 patent), the full and entire contents of which are incorporated herein by reference.

SUMMARY OF THE INVENTION

It is an object of the present invention to provide a cart of the aforementioned type, as generally described in the '123 patent, but with improved stairs climbing functionalities.

Another object of the present invention is to provide a cart of the aforementioned type of improved capabilities and simplified construction.

In preferred embodiments described below, the present disclosure is directed to a wheeling apparatus for wheeling a load, the wheeling apparatus comprising: a wheeling frame defining a frame plane, the wheeling frame being removably securable to the load; a wheeling leg assembly pivotably attached to the wheeling frame at a pivoting axis and being pivotably moveable between a first position adjacent and parallel to the wheeling frame plane and a second position extending at an adjustable angle to the wheeling frame plane; a pair leaning wheels secured to the wheeling leg assembly; a fastening system structured to removably secure the wheeling frame to the load; a spring biased mechanism configured and biased to urge the wheeling leg assembly toward the second position and yieldingly holding the wheeling leg assembly at the second position; and a flexible wire having a first end attached to the wheeling leg assembly and a second end attachable to a holding device that is configured to firmly hold the second end at an adjustable location thereon and which is so configured as to allow a user to selectively adjust an inclination angle at which the wheeling leg assembly extends relative to the frame plane during use of the apparatus. The load can be suitcase that has load wheels. The leg assembly comprises first and second spaced legs, each having a respective one of the pair of leaning wheels secured thereto. A handle assembly is retractably mounted in the wheeling frame and which is structured to extend out of the frame generally in the direction away from an upper cross bar of the frame. A pulling strap is connected to an upper cross, holding handle of the handle assembly.

The wheeling leg assembly is structured to pivot out of the frame plane about a pivot axis, and an adjusting mechanism structured to allow adjusting the inclination angle of the wheeling leg assembly relative to the frame plane. Preferably, the flexible wire includes a first section that extends from wheeling leg assembly to a given location on the wheeling frame and a second section that extends from the given location toward an upper cross bar of the wheeling frame. The free end of the second section of the wire is secured by a free end securing device comprising one of a pin, a cleat and a clamp. The wire is connected at one end to the cross bar, is wound around a roller attached to the wheeling frame and extends in the wheeling frame to the securing device.

Preferably, the wheeling frame includes a ledge for supporting the suitcase thereon. The leaning wheels are adjacent the ledge in a stowed position of the wheeling apparatus. The fastening system comprises a plurality of interlocking straps which are structured to grasp around and tightly secure the load to the wheeling frame. The wheeling apparatus has a thickness dimension, in a stowed position of the wheeling leg assembly, of less than two inches. The wheeling leg assembly has a length dimension of greater than 16 inches. The wheeling apparatus is configured to enable the suitcase to be either pushed or pulled over a surface in a leaned position by applying a pushing or pulling force, respectively to the wheeling apparatus. The wheeling apparatus is configured to allow moving the suitcase on stairs while supporting at all times the weight of the suitcase on one or both of the load wheels of the suitcase and the leaning wheels of the wheeling apparatus.

Other features and advantages of the present invention will become apparent from the following description of the invention which refers to the accompanying drawings.

DETAILED DESCRIPTION OF PREFERRED EMBODIMENTS OF THE INVENTION

Figure 1:
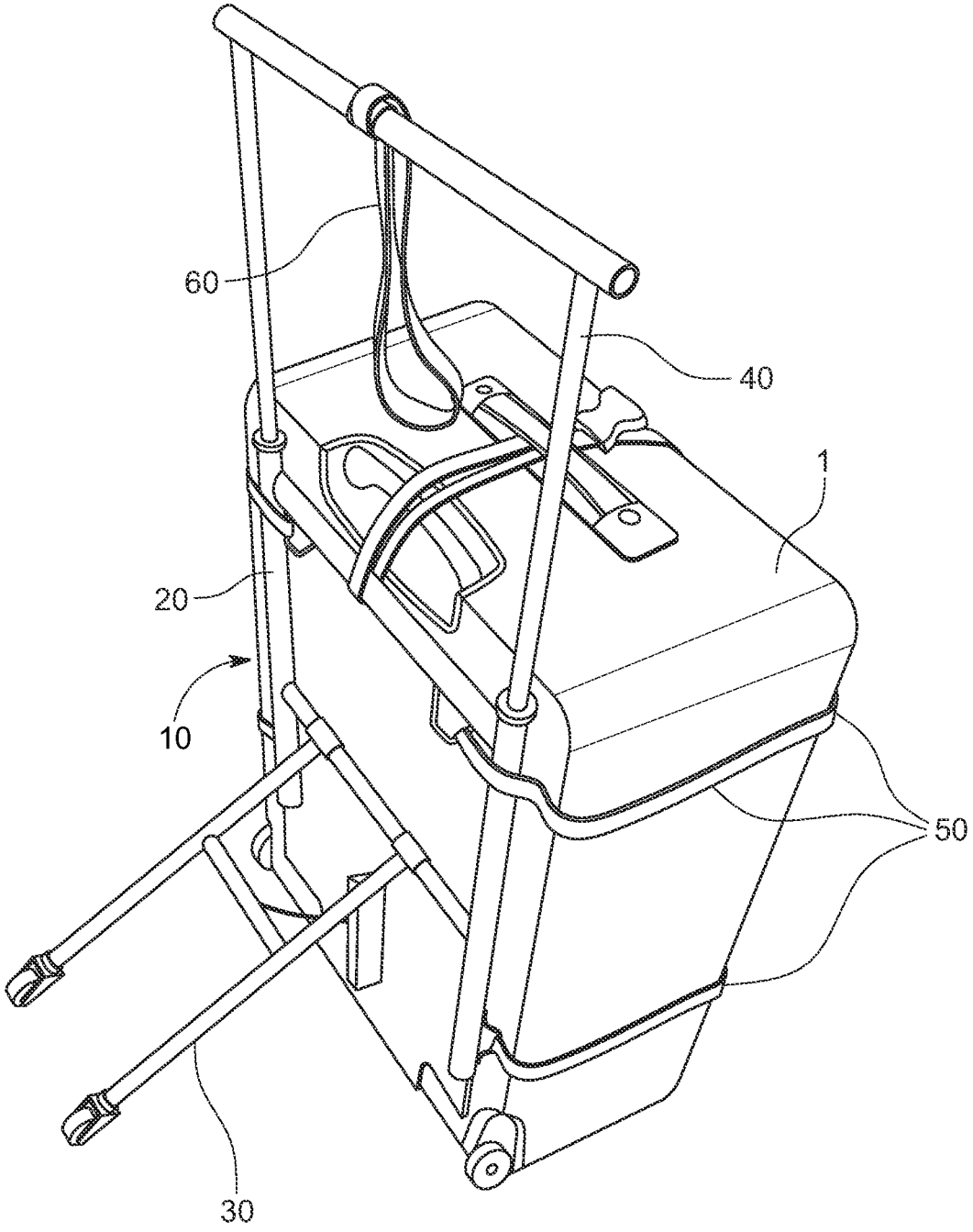
FIGS. 1 through 7 are perspectives of the load wheeling apparatus of the present invention.

With reference to FIG. 1, a luggage 1 becomes more mobile by attaching to it the cart frame 10 by several belts 50 that wrap around the luggage, sidewise and from above as well. As described in the '123 patent, the cart comprises a low-profile frame 20 (that preferably adds less than an inch or so to the thickness of the luggage), the frame 20 supporting leaning wheels assembly 30 that is pivotably connected to the frame 20, so that the leaning assembly 30 can be laid flat against the luggage 1 or pivoted away to allow the luggage to "lean" on the leaning assembly 30, as the luggage is pushed or pulled along the corridors of airports and the like. The angle of inclination of the leaning assembly is adjustable, for the less weight transfer to the leaning wheels the easier to "wheel" about the luggage. Note the extendable handle 40, which can be adjustably pulled out of the frame 20, and further note the horizontal holding bar to which is attached a pulling strap 60 (the length of which is adjustable). The pulling strap 60 is held to "pull" the luggage along the floor while the luggage 1 is "leaning" on the leaning assembly 30, and provides great comfort because the strap 60 self-adjust to the height or arm length or comport of person pulling the luggage, whether a child or a professional basketball player.

Figure 2:
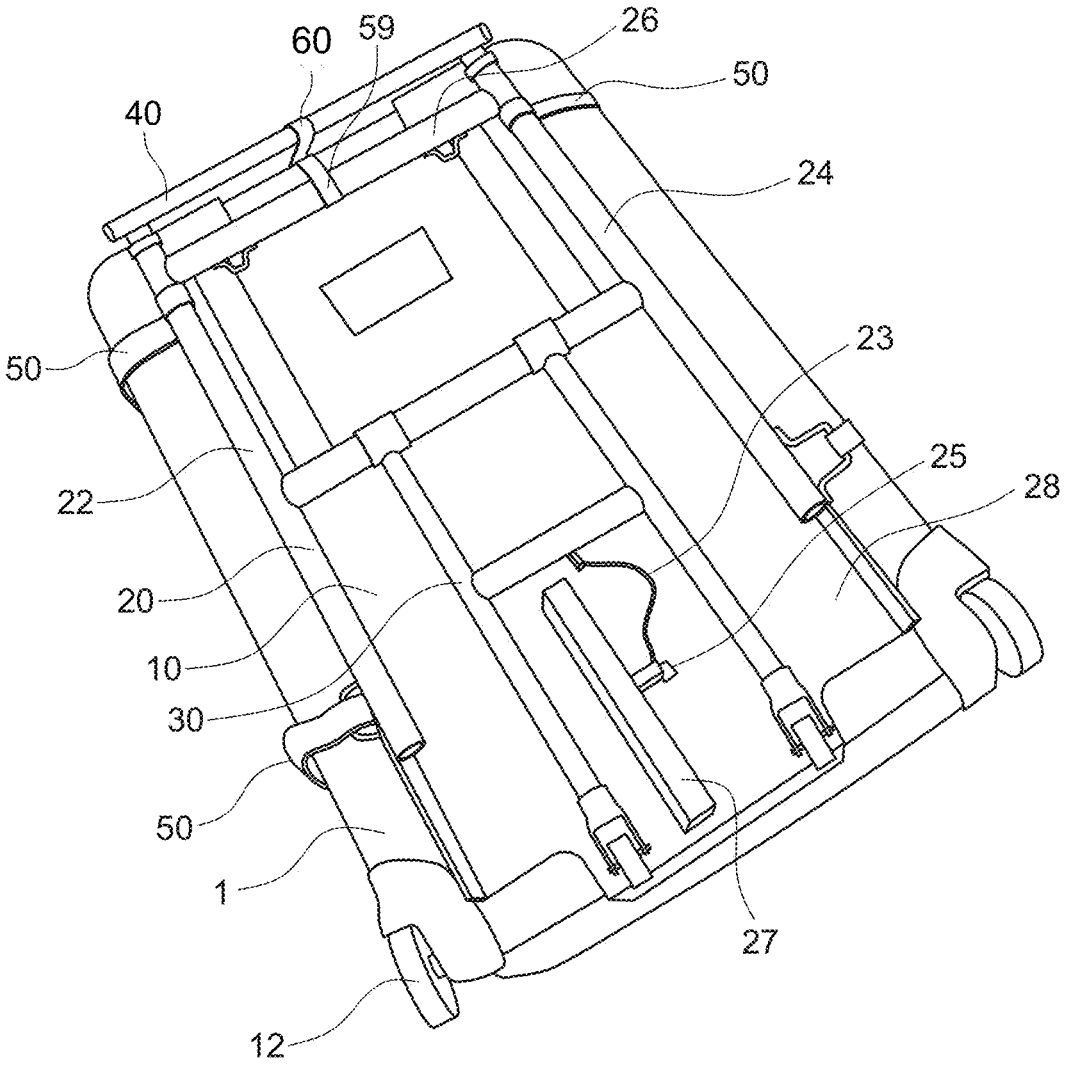
Figure 3:
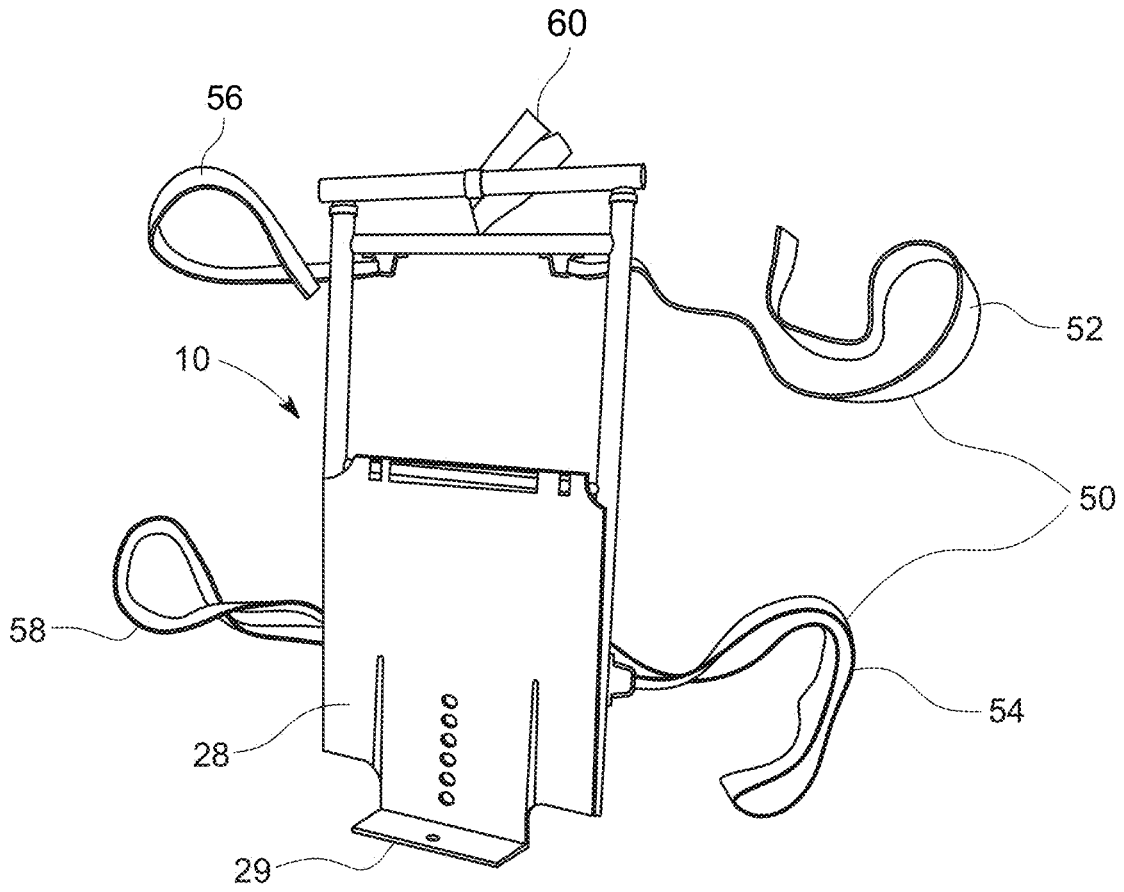

FIG. 2 shows the cart 10 still attached to the luggage 1 but in a stage position, with the handle 40 pushed into the frame 20 and the leaning assembly 30 collapsed and flattened against the luggage. The frame has a left member 22, a right member 24, an upper horizontal bar 26 and a bottom support plate 28, with an inwardly bent ledge 29 (FIG. 3) designed to rest and support the luggage 1 thereon. Note the wheels 12 of the luggage, which bears almost all or at least most of the weight of the luggage 1 in normal use.

Figure 4:
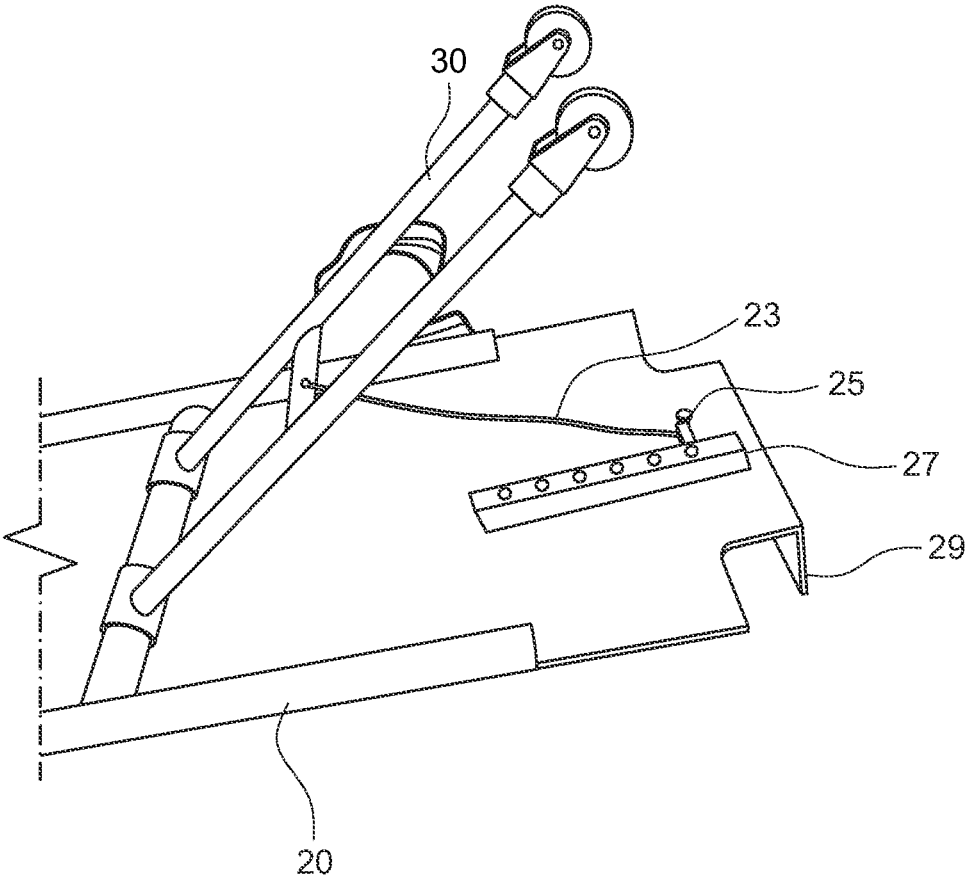
Figure 5:
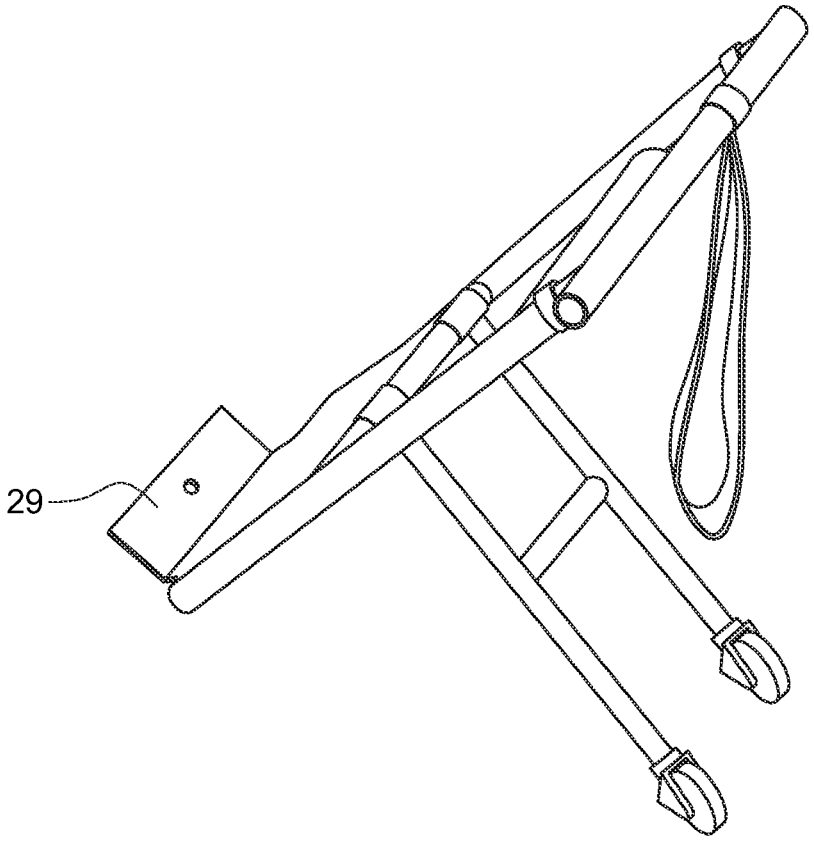
Figure 6:
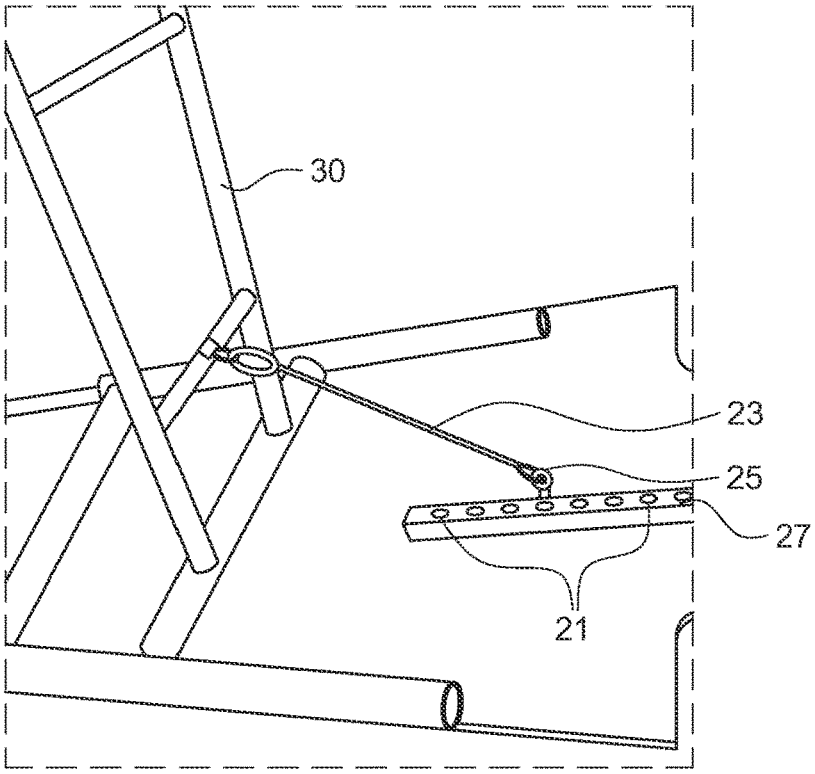
Figure 7:
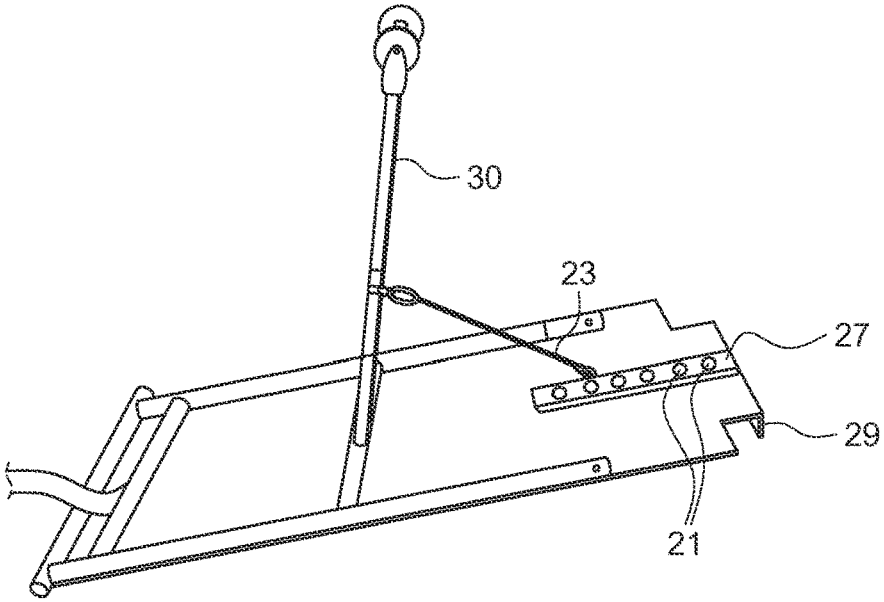

The angle of inclination of the leaning assembly 30 is adjustably controlled by the wire 23 which is attached at one end to the leaning assembly and at the other end to the insertable pin 25, which can be selectively inserted into a selected one of the holes in the rod 27 adjusting the extension length of the wire 23 (and thereby the angle of inclination). The luggage strapping system 50 (FIG. 3) comprises sidewise extending straps 52, 54, 56, 58 and 59 and lengthwise extending upper strap, enabling firm strapping of the frame 20 to the luggage 1 with no sideways or lengthwise movement. FIG. 4 shows the frame 20, with the holes in the bar 27 that allow adjusting the length of the wire 23 and thereby the angle of inclination of the leaning assembly 30. FIG. 5 shows the frame 10 with the luggage ledge 29, the angle of inclination set at about 90 degrees and the handle 40 and pulling strap 60. The holes 21 are shown in FIG. 7, with the angle of inclination set at about 70 degrees or so.

Figure 8:
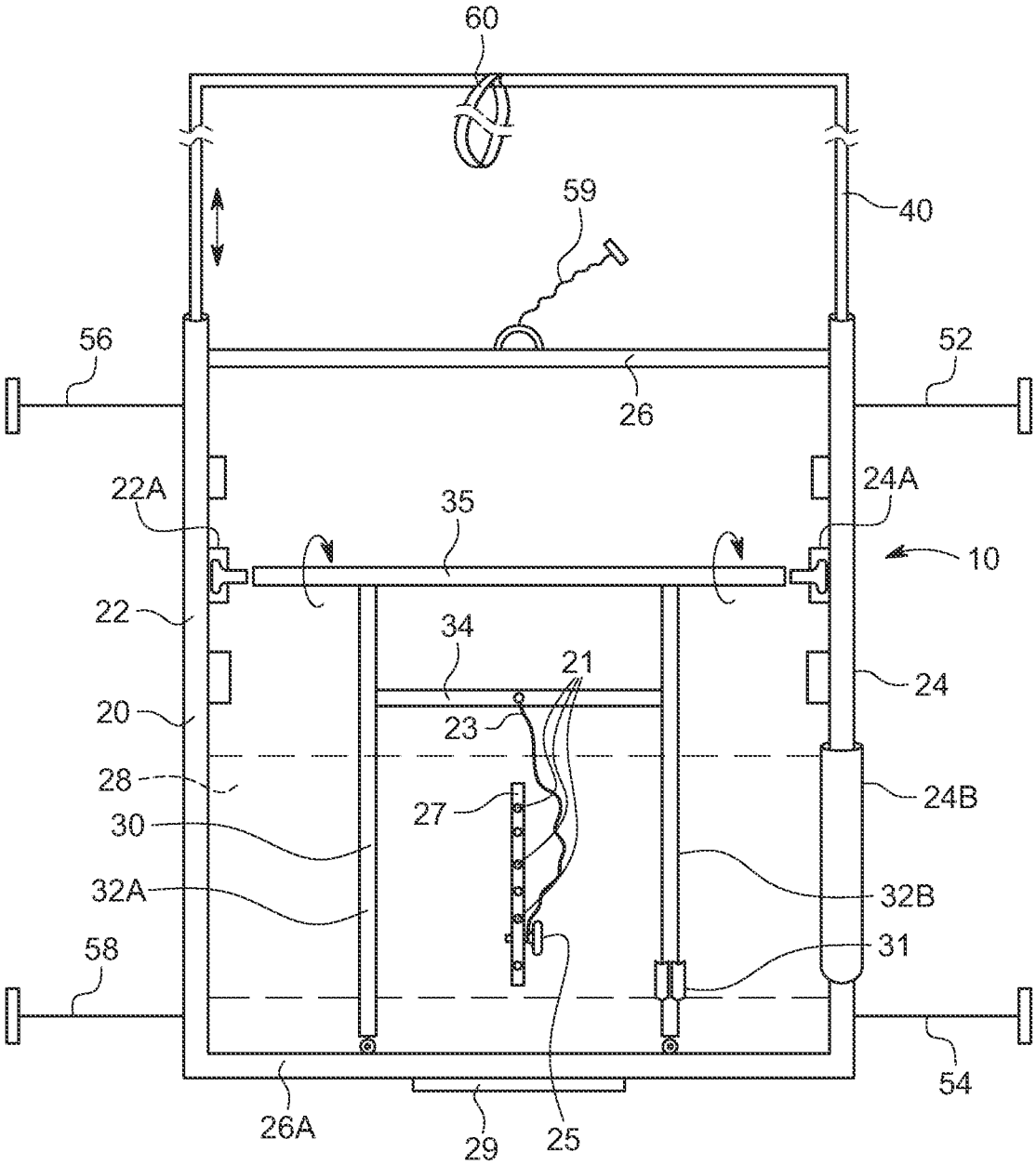
FIGS. 8 through 10 and 10A are diagrams explicating the mechanisms of the load wheeling apparatus.

FIG. 8 shows the frame 20 described above diagrammatically, with some modifications. The plate 28 of the frame 20 is shown in dashed lines to indicate its optional nature. Instead, the frame may comprise a bottom horizontal member 26A to complete the frame (and the bar 27 may be supported by connecting between the members 26A and 26, or in a variety of other ways). The frame member 26 has a wire or strap 59 coupled to it. The leaning assembly 30 is pivotably connected to the side frame members 20, 24 and means are provided to bias the leaning legs 32A, 32B of the assembly to pivot away from the plane of the frame as indicated by the curved arrows around the member 35. The leaning assembly 30 is connected to the frame 20 by and at the couplings 22A, 24A. The reference numeric 24B at the indicated region on the frame member is coated with a low friction material to allow easy sliding (for a purpose explained later). The opposed frame member is also coated. When the leaning legs are pushed down, they are held by the snap (or similar) locking tab 31 for storage purposes.

Figure 9:
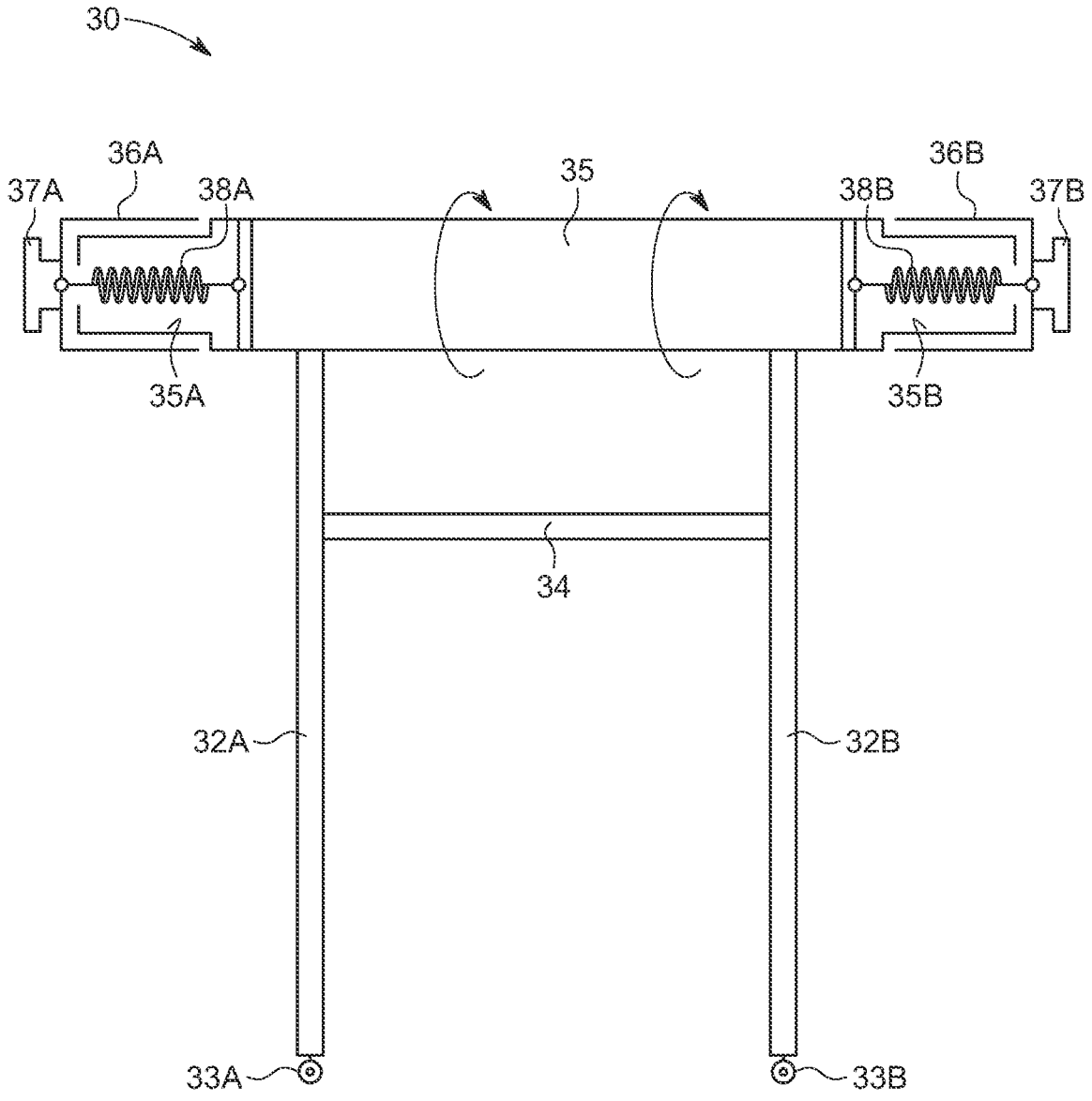

As shown in FIG. 9, the leaning assembly may comprise the left and right narrowed diameter sections 35A, 35B that just fit inside end caps 36A, 36*b*, respectively. The respective torsion springs 38A, 38B connect at one end to the cross bar inside the bar 35 and at the their other ends to the end caps, the torsion springs being pre-wound so that with the end cap connectors 37A, 37B are fixed to the frame 20, the leaning wheels 32A, 32B with are biased to rotate as indicated by the angular arrows (out of the plane of the paper). Note the wheels 33A, 33B.

Figure 10:
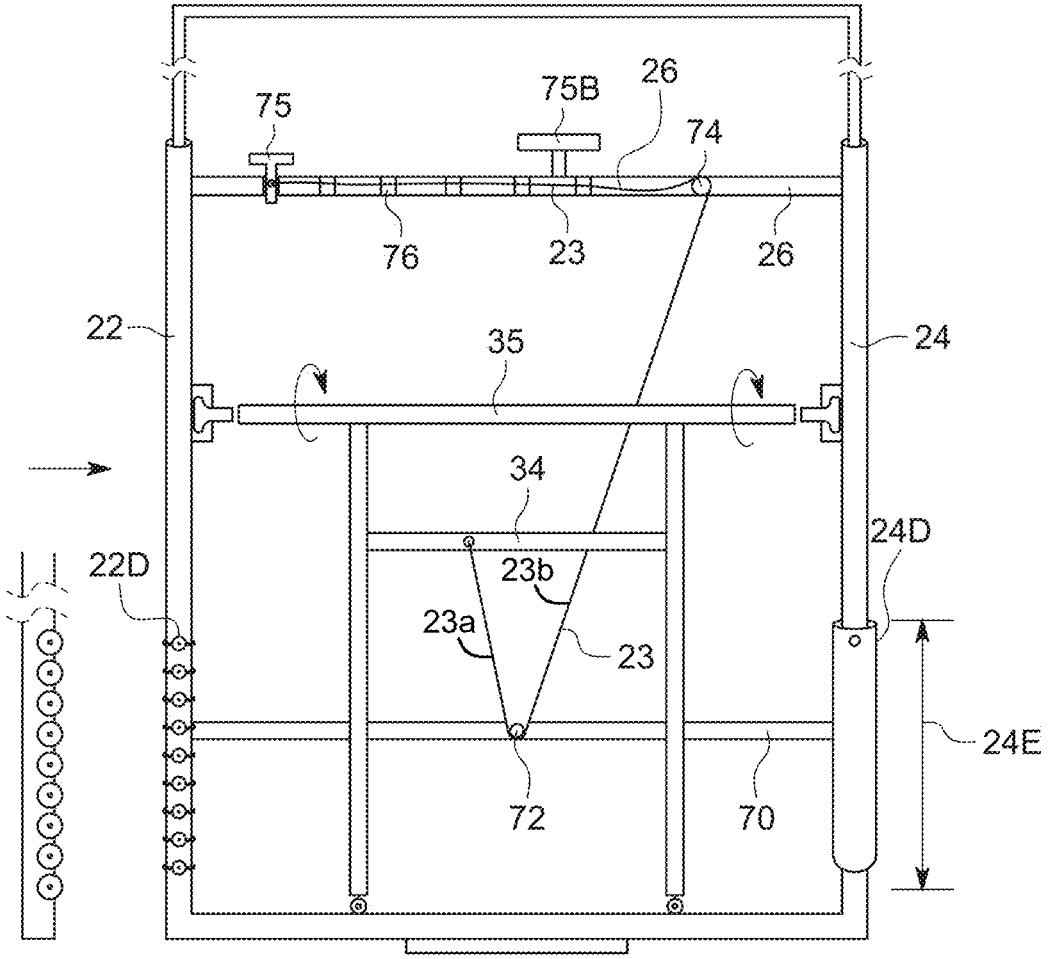
Figure 10A:
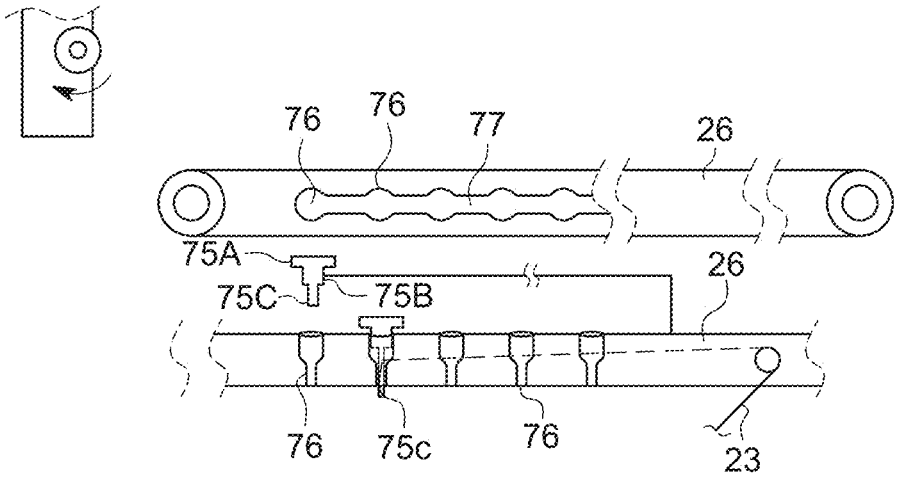

FIGS. 10 and 10A show a modified angle controller for the leaning assembly. Here, the wire 23 is connected at one end to the cross bar 34, is wound around a roller 72, passed by and under the member 34, then around a second roller 74 provided at the frame member 26, continues horizontally through the frame member 26, with the other end of the wire 23 connected to the pin 75. The wire extension from the cross bar 34 to the roller 72 is designated by reference 23*a*, and the section of the wire 23 extending from the roller 72 to the second roller 74 is designated by reference 23*b*. As shown in FIG. 10A, the pin 75 has a grasping button 75A, a thick section 75B and a narrow diameter section 75C. This enables lifting the pin to slide it through the channel 77 and thereby anchor its position in a desired one of the holes 77. Doing so allows a user to change the length of the wire extension from the bar 34 to the roller 72 and thereby the angle of inclination, at the highly accessibly frame member 26, enabling setting the angle at what is most comfortable to the user or suitable for the particular piece of luggage being wheeled about. The same function can be achieved in other ways, for example by providing a cleat 75*b* (shown in dotted lines) and wrapping the free end of the wire around it to adjust the wire length (and hence the angle of inclination of the leaning wheel assembly. As another option, the item 75*b* represents (symbolically) a clamp that that clamps the wire to adjust its length. The wire 23 can be made of metal, or non-metal stock or even combination of the above with a first section made of wire (the section attached to the leaning frame) and another section that is used by the user to adjust the overall wire length that is made of more flexible fibers made of synthetic or cloth fibers.

Also indicated in FIG. 10 is that the frame members 22, 24 can have the section 24E provided with tiny bearings/rollers 22D, 24D, which jut out of the frame (which serve as anti-friction elements). In one embodiment, these rollers are ratcheted to turn on only one direction, so that the location allows easy sliding of the frame 20 against another surface in only one direction, which is useful for stairs climbing.

Figure 11:
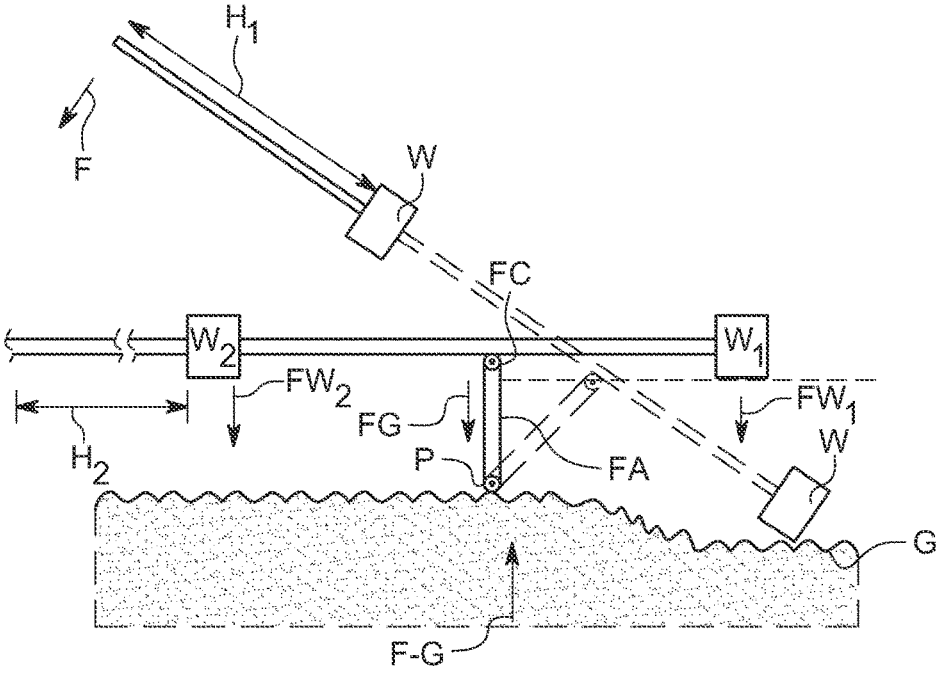
FIGS. 11 through 16 diagrammatically illustrate the stairs climbing aspects of the load wheeling apparatus.

The stairs climbing feature and embodiments of the cart 10 of the present invention employ the physical principles behind a seesaw or a weighing balance scale, as well as the fact that, rather than lifting a load straight up, i.e., vertically, it is far easier to lift a weight by pulling on a rope that causes the weight to rise. The method allows using one's own weight to raise another weight. The physical principles at play are partially illustrated in FIG. 11. The weight W1 connected to one end of the bar is balanced by the identical weight W2, assuming identical distance from the fulcrum FC. Ignoring friction, it takes zero force or work to move either weight up/down. If the left side is twice as far from FC, the weight is halved, or the force needed to raise the W1 is halved. Here, the ground connection P is allowed to pivot and to return to the original orientation requires some "work", where "work" equals the force applied multiplied by distance over which the force is applied.

Figure 12:
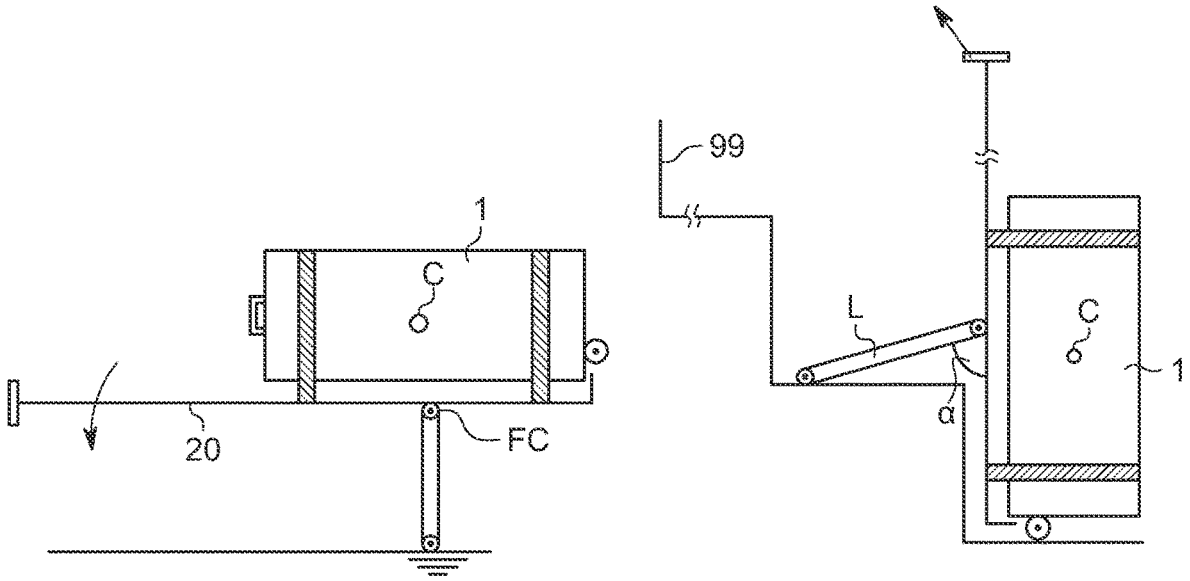

In FIG. 12 (left sketch), assuming the center of weight/mass center C is over the fulcrum FC, it takes no work at all to change the orientation of the suitcase 1 from vertical to horizontal. But it does take force/work to do so in the sketch to the right. The angle "a" is fixed, but the leaning leg "L" is almost horizontal and to raise the suitcase 1 to next step, upper step of the stairs 99 requires force/work. But here, a person standing higher up on the stairs 99 is pulling on the long handle (which is much farther away from the center C) is bend backward and using his/her weight to partially overcome the downward gravity force.

Figure 13:
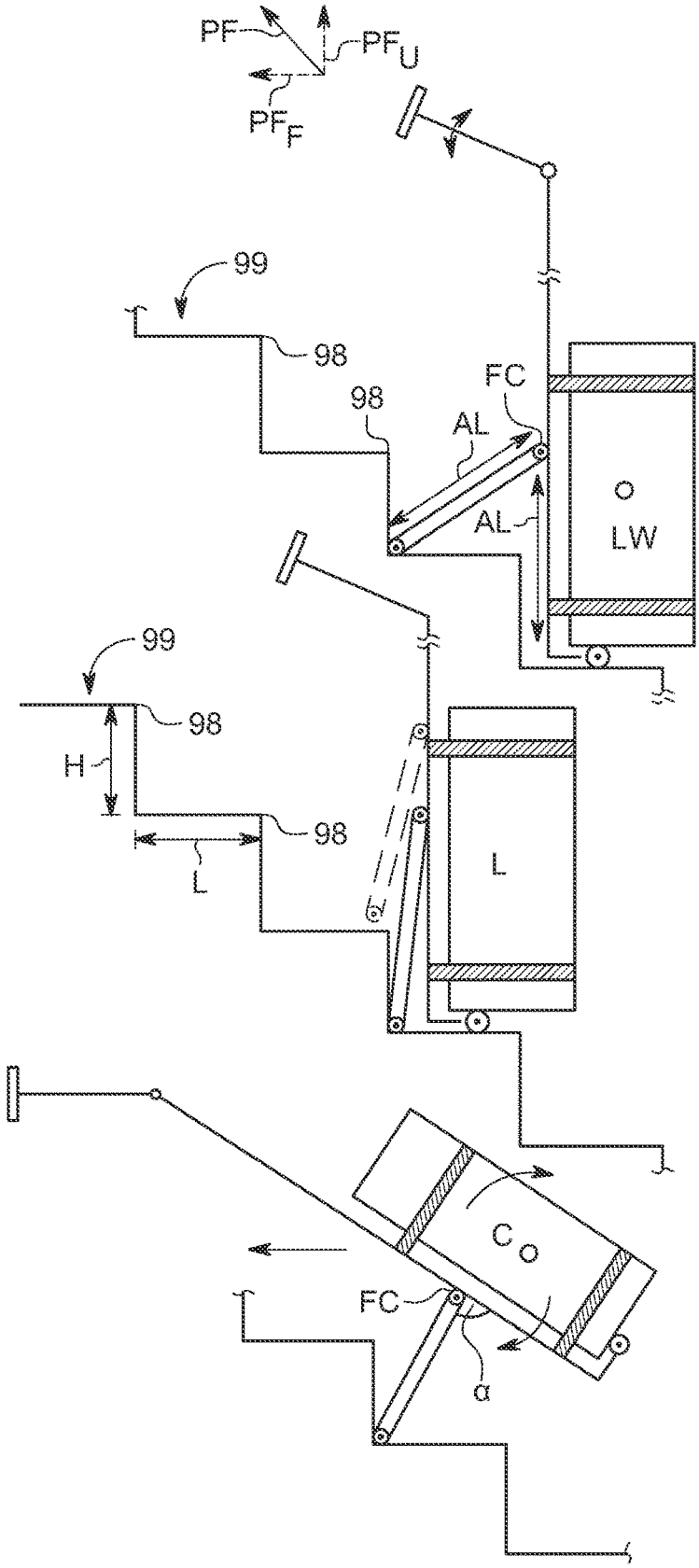

As shown in FIG. 13, initially the suitcase is on the bottom step and the leaning leg (which is approximately the same length as the distance from the fulcrum FC to the bottom of the suitcase) is on the second step, wedged at the corner, as shown at the upper sketch. When pulling on the handle (through the strap, as shown in the bottom sketch), the suitcase turn toward becoming more horizontally oriented as well gaining speed/momentum to travel to the left in the figure. Simply by changing the direction of pulling on the handle (through the strap) causes the suitcase to begin rotating counter-clockwise, as indicated by the arrow, which at the same time period reduces the size of the angle $\alpha$, causing the suitcase to reorient vertically as it lands on the next step (center sketch). At this point, suitcase can be leaned back to allow the leaning leg pivot away from the suitcase and onto the next higher step.

Figure 14:
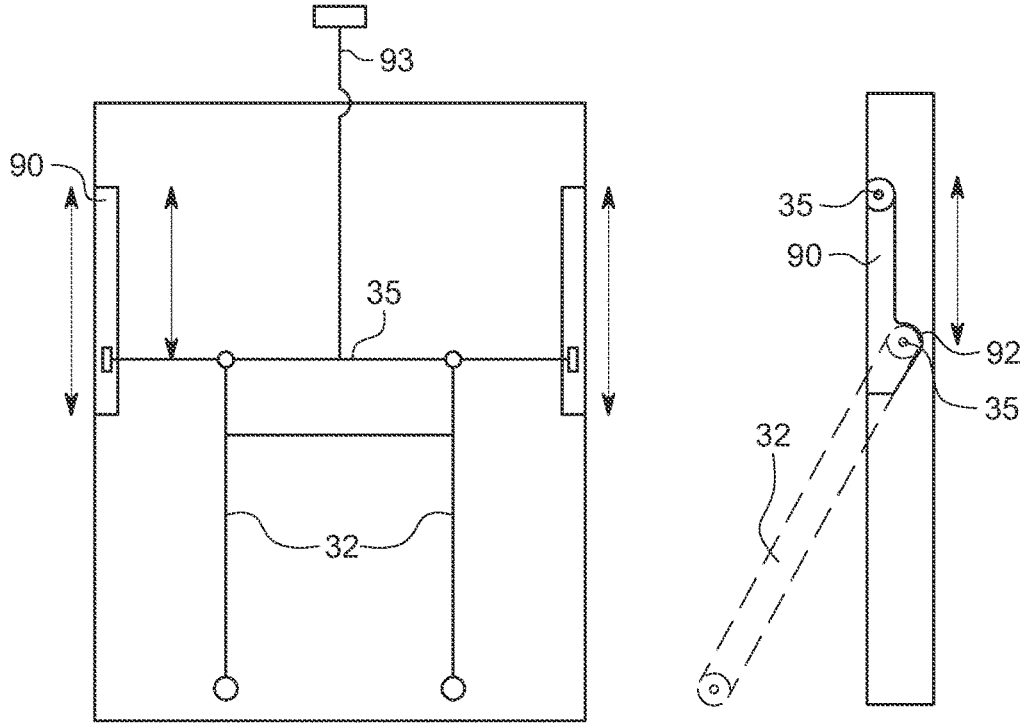

To avoid having to lean the suitcase backwards during stairs climbing, and as shown in FIG. 14, the cross bar 35 of the leaning assembly 30 may be made movable vertically in a channel 90 that has a nook or hook 92. Normally, the bar 35 is located in the nook 92. But the raise the leaning legs 32 to the next higher step, one operated the climbing handle down, out and then up, causing the assembly 30 to move up in the frame 20, thereby enabling the assembly 30 to pivot out and onto the next higher step.

Figure 15:
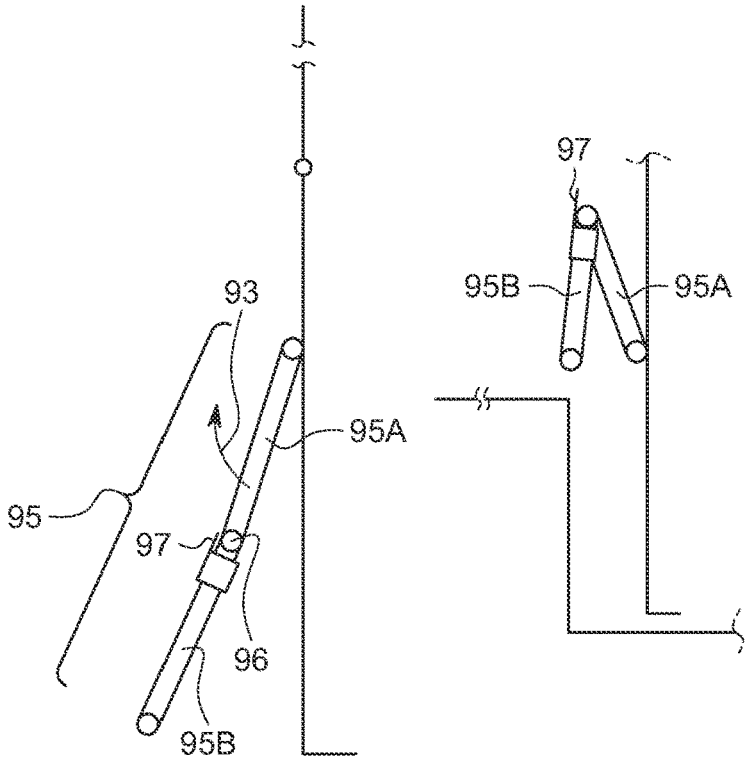

In the embodiment of FIG. 15, the legs 95 (corresponding to 32) are each made of two sections 95A, 95B pivotably connected at pivot 96. Pulling on the upper leg section 95A (as indicated by the arrow 93), folds the leg 95, enabling it to be moved to the next higher step. The blocking tab 97 prevents folding of the leg sections in the other direction. A spring (not shown) biases the legs sections to remain normally linear. As an aside, another solution to the task of raising the leaning wheels 32 to the next higher step is to mount them on a swivel that allows the leaning wheels to pivot sideways, in a plane parallel to that of the frame 20. Thus, the leaning wheels are swiveled sideways to clear the edge of the higher step and then swiveled back to continue the stair climbing operation.

Figure 16:
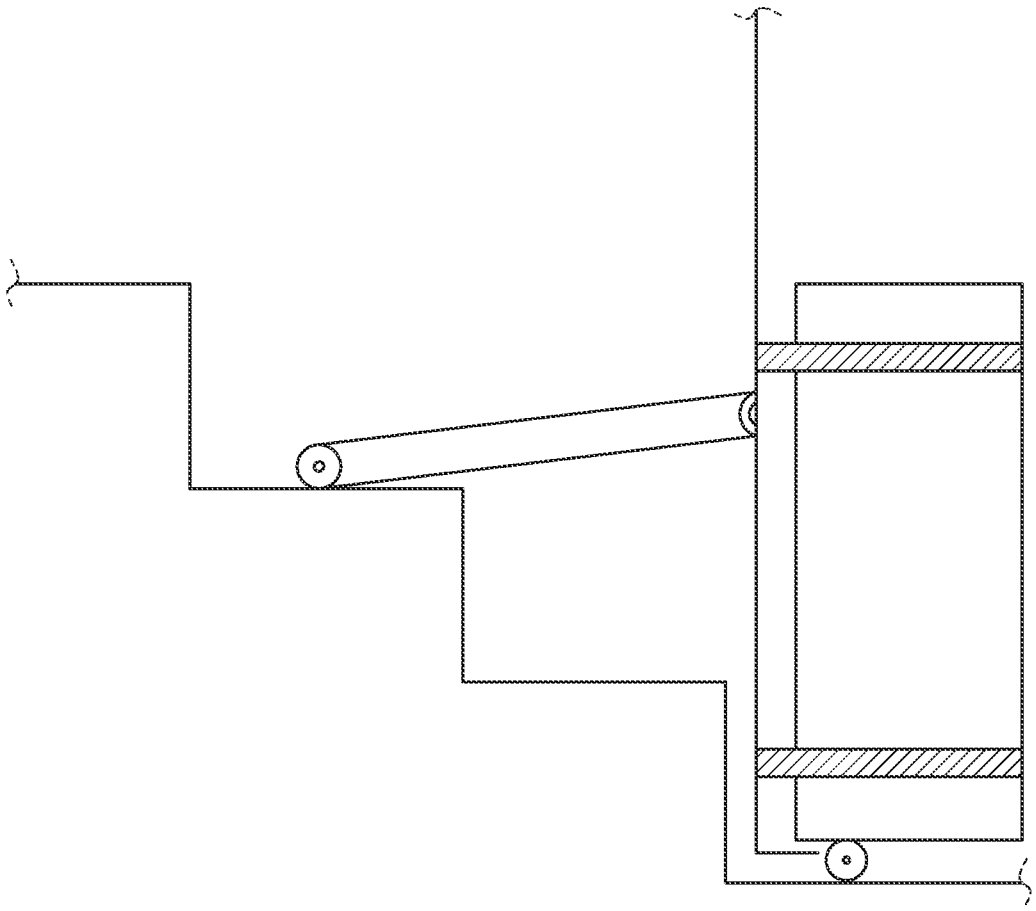

To avoid the complication and added complexity needed to move the leaning assembly 30 to the next higher step, the embodiment of FIG. 16 arranges and makes the leaning assembly 30 of a size that allows it to reach two steps up. Here, once the suitcase is raised to the next step, it does not wedge or cram the leaning wheels, which are easily repositioned one step higher, i.e. two steps higher up than the suitcase.

Walking the suitcase down a staircase is the reverse process. In FIG. 16, the user rolls the suitcase toward the edge of the step on which it is currently positioned, and then steps on the leaning wheels 35 down to below step, followed by pulling on the strap which renders the suitcase somewhat horizontal, enabling it to slide on its back to the step below.

Turning back to FIG. 10, when moving the suitcase 1 up or down the steps of a staircase 99, it often occurs that the bottom section of the frame 20 contacts the edges 98 (FIG. 9) of the steps and "slides" for a brief period on those edges 98. To ease the sliding (or prevent damaging the frame or the steps) the frame surfaces are either coated with an anti-friction material, or provided with the protruding rolling balls 22D, 24D. This feature also makes it easier to pull the suitcase during a stair climbing, even though the bottom of the frame is in contact with the step edges.

Although the present invention has been described in relation to particular embodiments thereof, many other variations and modifications and other uses will become apparent to those skilled in the art. It is preferred, therefore, that the present invention be limited not by the specific disclosure herein, but only by the appended claim.

What is claimed is:

1. A wheeling apparatus for wheeling a load, the wheeling apparatus comprising:

a wheeling frame defining a frame plane, the wheeling frame being removably securable to the load;

a wheeling leg assembly pivotably attached to the wheeling frame at a pivot axis and being pivotably rotatable between a first position adjacent and parallel to the wheeling frame plane and a second position extending at an adjustable angle to the wheeling frame plane;

a pair of leaning wheels secured to the wheeling leg assembly;

a fastening system structured to removably secure the wheeling frame to the load;

a spring-based biasing mechanism, including at least one spring, configured and biased to urge the wheeling leg assembly to pivotably rotate toward the second position and to yieldingly hold the wheeling leg assembly at the second position; and a wire having a first end coupled to the wheeling leg assembly, the wire being also coupled to the wheeling frame in a manner so that one of (a) a length of the wire extending from the wheeling leg assembly to the wheeling frame and (b) a location point of a second end of the wire on the wheeling frame, is adjustable, in a manner such that the wire operating with the biasing mechanism enable a user to selectively adjust an inclination angle at which the wheeling leg assembly yieldingly extends relative to the frame plane during use of the apparatus.

2. The wheeling apparatus of claim 1, wherein the load is a suitcase having load wheels.

3. The wheeling apparatus of claim 2, wherein the wheeling frame includes a ledge for supporting the suitcase thereon.

4. The wheeling apparatus of claim 3, wherein the leaning wheels are adjacent the ledge in a stowed position of the wheeling apparatus.

5. The wheeling apparatus of claim 2, wherein the fastening system comprises a plurality of interlocking straps which are structured to grasp around and tightly secure the load to the wheeling frame.

6. The wheeling apparatus of claim 2, wherein the wheeling apparatus has a thickness dimension, in a stowed position of the wheeling leg assembly, of less than two inches.

7. The wheeling apparatus of claim 2, wherein the wheeling leg assembly has a length dimension of greater than 16 inches.

8. The wheeling apparatus of claim 2, wherein the wheeling apparatus is configured to enable the suitcase to be either pushed or pulled over a surface in a leaned position by applying a pushing or pulling force, respectively to the wheeling apparatus.

9. The wheeling apparatus of claim 2, wherein the wheeling apparatus is configured to allow moving the suitcase on stairs while supporting at all times the weight of the suitcase on one or both of the load wheels of the suitcase and the leaning wheels of the wheeling apparatus.

10. The wheeling apparatus of claim 1, wherein the wheeling leg assembly comprises first and second spaced legs, each having a respective one of the pair of leaning wheels secured thereto.

11. The wheeling apparatus of claim 10, including a handle assembly which is retractably mounted in the wheeling frame and which is structured to extend out of the wheeling frame generally in the direction away from an upper cross bar of the frame.

12. The wheeling apparatus of claim 11, including a pulling strap connected to a horizontal bar of the handle assembly.

13. The wheeling frame of claim 11, wherein the wheeling leg assembly is structured to pivot out of the frame plane about the pivot axis.

14. The wheeling apparatus frame of claim 10, wherein the wire includes a first section that extends from the wheeling leg assembly to the location point on the wheeling frame and a second section that extends from the location point on the wheeling frame toward a cross bar of the wheeling frame, with a distal end of the second section enabling the user to pull on or relieve tension in the wire to alter the length of the wire extending from the wheeling leg assembly to the wheeling frame.

15. The wheeling apparatus frame of claim 14, wherein a free end of the second section of the wire is secured by a free end securing device comprising one of a pin, a cleat and a clamp.

16. The wheeling apparatus frame of claim 15, wherein the wire is connected at one end to the cross bar, is wound around a roller attached to the wheeling frame and extends in the wheeling frame to the securing device.

17. A wheeling apparatus for wheeling a load, the wheeling apparatus comprising:

a wheeling frame defining a frame plane, the wheeling frame being removably securable to the load;

a wheeling leg assembly pivotably attached to the wheeling frame at a pivoting axis and being pivotably rotatable between a first position adjacent and parallel to the wheeling frame plane and a second position extending at an adjustable angle to the wheeling frame plane;

a pair of leaning wheels secured to the wheeling leg assembly;

a fastening system structured to removably secure the wheeling frame to the load;

a spring-based biasing mechanism, including at least one spring, configured and biased to urge the wheeling leg assembly to rotate toward the second position and to yieldingly hold the wheeling leg assembly at the second position; and a wire having a first end coupled to the wheeling leg assembly, the wire having a second end attachable to a selectable location on the wheeling frame in a manner so that a length of the wire extending from the wheeling leg assembly to the selectable location on the wheeling frame and a biasing force of the biasing mechanism determine an inclination angle at which the wheeling leg assembly yieldingly extends relative to the frame plane during use of the apparatus.

* * * * *